US008855543B2

(12) United States Patent
Deguchi et al.

(10) Patent No.: US 8,855,543 B2
(45) Date of Patent: Oct. 7, 2014

(54) TRANSFER DEVICE

(75) Inventors: Hideaki Deguchi, Tenpaku-ku (JP); Keita Hironaka, Obu (JP); Yusuke Ozaki, Nagoya (JP); Motoaki Mushika, Hashima (JP); Hikaru Yoshizumi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 32 days.

(21) Appl. No.: 13/617,219

(22) Filed: Sep. 14, 2012

(65) Prior Publication Data

US 2013/0108343 A1 May 2, 2013

(30) Foreign Application Priority Data

Nov. 2, 2011 (JP) ..... 2011-241200

(51) Int. Cl.
*G03G 15/00* (2006.01)
*G03G 15/16* (2006.01)

(52) U.S. Cl.
CPC ..... *G03G 15/6558* (2013.01); *G03G 15/1665* (2013.01)
USPC ..... 399/388; 399/316; 399/317

(58) Field of Classification Search
USPC ..... 399/316, 317, 388, 394
See application file for complete search history.

(56) References Cited

U.S. PATENT DOCUMENTS 7,113,734 B2 9/2006 Deguchi et al.
7,346,304 B2 3/2008 Takagi
7,539,446 B2 * 5/2009 Deguchi ..... 399/316
7,539,448 B2 * 5/2009 Miwa et al. ..... 399/316
8,055,171 B2 * 11/2011 Ueyama et al. ..... 399/316
2005/0069343 A1 3/2005 Deguchi et al.
2006/0171760 A1 8/2006 Deguchi
2006/0238788 A1 10/2006 Takagi
2007/0269242 A1 11/2007 Hattori et al.
2007/0269243 A1 11/2007 Uehara et al.
2007/0269244 A1 11/2007 Miwa et al.
2008/0298859 A1 12/2008 Ueyama et al.
2012/0243917 A1 9/2012 Deguchi et al.
2012/0243918 A1 9/2012 Deguchi et al.
2013/0106051 A1 5/2013 Deguchi et al.

FOREIGN PATENT DOCUMENTS

JP 2005-128482 A 5/2005
JP 2006-208839 A 8/2006
JP 2006-208840 A 8/2006

(Continued)

*Primary Examiner* — Jill Culler
*Assistant Examiner* — Justin Olamit
(74) *Attorney, Agent, or Firm* — Banner & Witcoff, Ltd.

(57) ABSTRACT

In a transfer device, a first side of a flexible guide plate faces to a recording medium being conveyed along a medium conveyance path to guide the recording medium toward an image carrying member. A support frame supports an upstream end portion of the guide plate, and includes an opposite portion disposed from and opposite to a second side (reverse to the first side) of the guide plate and a rib configured to protrude from the opposite portion toward the medium conveyance path. The rib has a first edge which is positioned at an upstream side and beyond which the guide plate protrudes downstream. The rib has an inclined surface extending from the first edge in a direction obliquely downstream toward the image carrying member. The guide plate includes an indentation to allow the guide plate to be deflected without being blocked by the rib.

5 Claims, 2 Drawing Sheets

(56) References Cited

FOREIGN PATENT DOCUMENTS

| | | | |
|---|---|---|---|
| JP | 2006-301490 | A | 11/2006 |
| JP | 2008-026808 | A | 2/2008 |
| JP | 2008-026809 | A | 2/2008 |
| JP | 2008-297044 | A | 12/2008 |
| JP | 2012-203225 | A | 10/2012 |
| JP | 2012-203227 | A | 10/2012 |
| JP | 2013-097251 | A | 5/2013 |

* cited by examiner

TRANSFER DEVICE

CROSS-REFERENCE TO RELATED APPLICATION(S)

This application claims priority from Japanese Patent Application No. 2011-241200 filed on Nov. 2, 2011, the disclosure of which is incorporated herein by reference in its entirety.

FIELD

Apparatuses consistent with one or more aspects of the present invention relate to a transfer device having a guide plate for guiding a recording medium toward an image carrying member.

BACKGROUND

A transfer device for transferring toner (developer) carried on a peripheral surface of a photoconductor drum (image carrying member) onto a recording sheet (recording medium) being conveyed along a sheet conveyance path (medium conveyance path) may be embodied as an image forming apparatus which includes a guide plate for guiding the recording sheet toward the photoconductor drum, and a sponge for supporting a rear end (at a trailing edge) of the sheet which has come off the guide plate. Typically, a distal end of the guide plate is disposed in a position proximate to the peripheral surface of the photoconductor drum while an upper surface of the sponge is disposed in a position remote from the peripheral surface of the photoconductor drum.

In this configuration where the upper surface of the sponge is disposed in a position remote from the peripheral surface of the photoconductor drum, the sheet with its rear end supported on the upper surface of the sponge would be in a position too remote from the photoconductor drum, such that an undesirable electric discharge could occur between the photoconductor drum and the sheet, which would disadvantageously cause the toner to scatter over the sheet which has not yet reached a predetermined transfer position (this phenomenon is called "pre-transfer").

SUMMARY

The sponge might be designed to be greater in height to address the aforementioned problem, but such a greater-height sponge would possibly be collided with, and snagged on, by a leading edge of a thicker sheet (stiffer and heavier sheet of paper such as a cardboard) which, when forwarded and guided along the guide plate, causes the guide plate to deflect.

The sponge might be so arranged under the distal end of the guide plate, to address the problem of colliding or snagging of the leading edge of a thicker sheet, but this would block the guide plate from being deflected, and thus could disadvantageously make it impossible to properly convey such a thicker sheet to the transfer position.

Against the backdrop, it would be desirable to provide a transfer device in which a stiffer recording medium such as a thick sheet or a cardboard can be conveyed smoothly and properly without blocking a guide plate from being deflected.

More specifically, in one or more embodiments, a transfer device for transferring developer carried on a peripheral surface of an image carrying member onto a recording medium being conveyed along a medium conveyance path is provided which comprises a transfer unit, a flexible guide plate and a support frame. The transfer unit is disposed opposite to the image carrying member and configured to transfer the developer from the peripheral surface of the image carrying member onto the recording medium. The guide plate has a first side and a second side reverse to the first side. The guide plate is disposed in a position along the medium conveyance path, upstream relative to a transfer position that is between the image carrying member and the transfer unit, such that the first side faces to the recording medium being conveyed along the medium conveyance path to guide the recording medium toward the image carrying member. The guide plate includes an upstream end portion disposed at a side facing in a direction upstream of the medium conveyance path. The support frame is configured to support the upstream end portion of the guide plate. The support frame includes an opposite portion and a rib. The opposite portion is disposed separate from and opposite to the second side of the guide plate. The rib is configured to protrude from the opposite portion toward the medium conveyance path and dimensioned to have a width smaller than that of the guide plate as measured in a direction of a width of the recording medium which is a direction perpendicular to a direction of conveyance of the recording medium. The rib has a first edge which is positioned at a side facing in the direction upstream of the medium conveyance path and beyond which the guide plate protrudes in a direction downstream of the medium conveyance path. The rib has an inclined surface extending from the first edge in a direction obliquely downstream of the medium conveyance path toward the image carrying member. The guide plate includes an indentation configured to allow the guide plate to be deflected without being blocked by the rib.

BRIEF DESCRIPTION OF THE DRAWINGS

The above and other aspects, other advantages and further features of the present invention will become more apparent by describing in detail illustrative, non-limiting embodiments thereof with reference to the accompanying drawings, in which.

DESCRIPTION OF EMBODIMENTS

Figure 1:
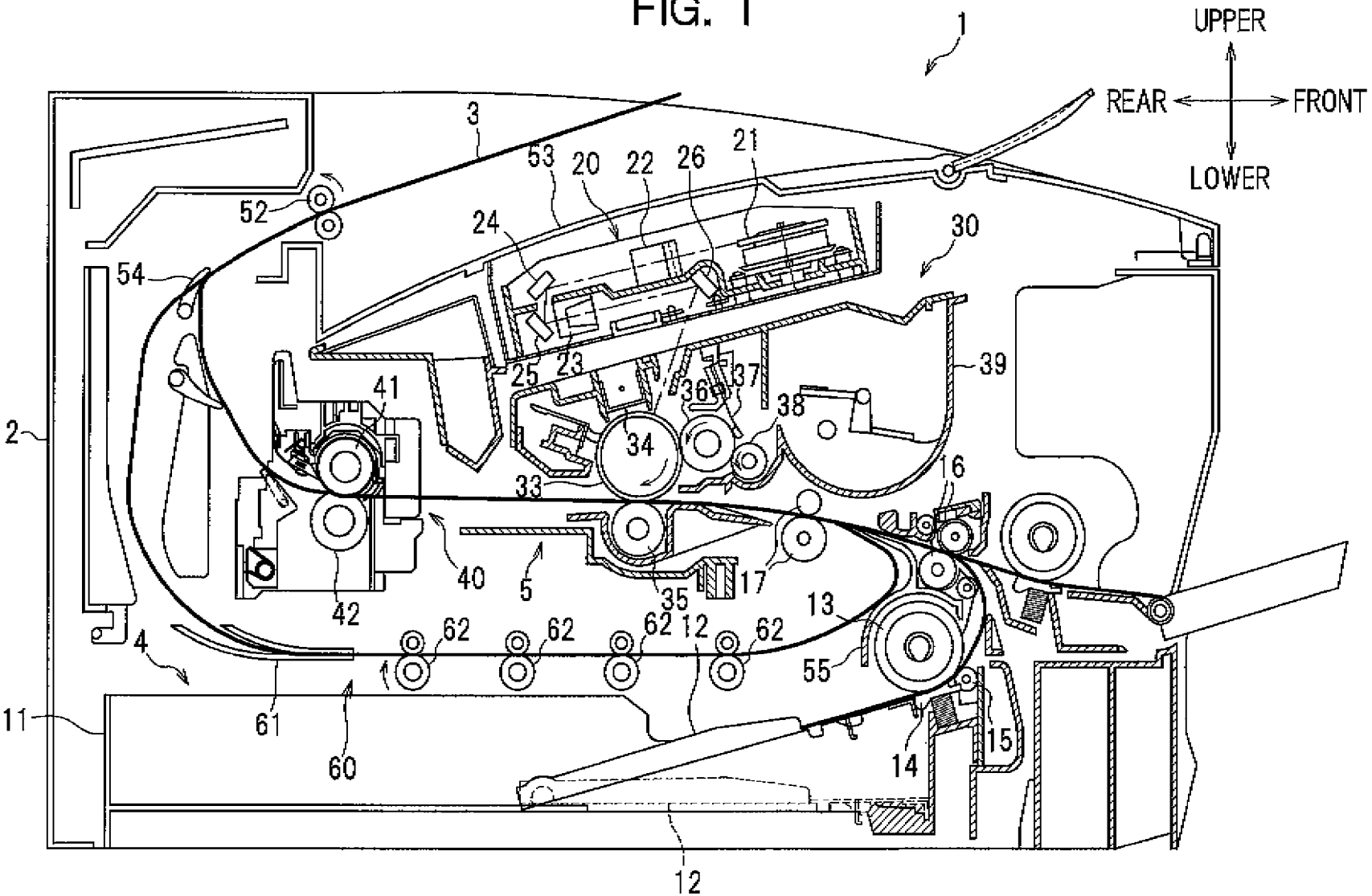
FIG. 1 is a schematic sectional view of a laser printer with a transfer device according to an illustrative embodiment of the present invention.

A detailed description will be given of illustrative, non-limiting embodiments of the present invention with reference made to the drawings where appropriate. In the following description, a general setup of a laser printer 1 with a process cartridge 30 as an example of a transfer device according to one embodiment of the present invention will be described briefly at the outset, and then features of the process cartridge 30 will be described in detail.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

As shown in FIG. 1, the laser printer 1 comprises a body casing 2, and several components housed within the body casing 2, which principally include a sheet feeder unit 4 for feeding a sheet 3 (e.g., of paper) as one example of a recording medium, and an image forming unit 5 for forming an image on the sheet 3 fed by the sheet feeder unit 4.

The sheet feeder unit 4 includes a sheet feed tray 11 removably installed in a bottom space within the body casing 2, and a sheet pressure plate 12 provided within the sheet feed tray 11. The sheet feeder unit 4 also includes a sheet feed roller 13 and a sheet feed pad 14 which are provided above a front end portion of the sheet feed tray 11, and a paper powder remover rollers 15, 16 provided in a position downstream relative to the sheet feed roller 13 in a direction of conveyance of the sheet 3 (along a sheet conveyance path). The sheet feeder unit 4 further includes a registration roller 17 provided in a position downstream relative to the paper powder remover rollers 15, 16 in the direction of conveyance of the sheet 3 (along the sheet conveyance path).

In the sheet feeder unit 4, sheets 3 in the sheet feed tray 11 are pressed against the sheet feed roller 13 by the sheet pressure plate 12, and each sheet 3, separated from the others and forwarded by the sheet feed roller 13 and the sheet feed pad 14, is conveyed through the paper powder remover rollers 15, 16 and the registration roller 17 into the image forming unit 5.

The image forming unit 5 includes a scanner unit 20, a process cartridge 30 (transfer device) and a fixing device 40.

The scanner unit 20 is provided in an upper space within the body casing 2, and includes a laser beam emitter (not shown), a polygon mirror 21, lenses 22, 23, reflecting mirrors 24, 25, 26. The scanner unit 20 is configured to cause a laser beam to travel along a path indicated by alternate long and short dashed lines, so that a surface (peripheral surface) of a photoconductor drum 33 as an example of an image carrying member, provided within the process cartridge 30, is rapidly scanned and illuminated consecutively with the laser beam.

The process cartridge 30 is provided below the scanner unit 20 within the body casing 2, and configured to be installable in and removable from the body casing 2. The process cartridge 30 includes a photoconductor drum 33, a scorotron charger 34, a transfer roller 35 as an example of a transfer unit, a development roller 36, a doctor blade 37, a supply roller 38 and a toner hopper 39.

In the process cartridge 30, the peripheral surface of the photoconductor drum 33 is uniformly charged by the scorotron charger 34, and then exposed to a laser beam from the scanner unit 20, so that an electrostatic latent image is formed on the peripheral surface of the photoconductor drum 33. Toner as an example of developer is stored in the toner hopper 39 and supplied from the toner hopper 39 to this electrostatic latent image via the supply roller 38 and the development roller 36, so that a toner image (developer image) is formed on the peripheral surface of the photoconductor drum 33. Thereafter, while a sheet 3 is conveyed through between the photoconductor drum 33 and the transfer roller 35, the toner image carried on the peripheral surface of the photoconductor drum 33 is transferred onto the sheet 3 by a transfer bias applied to the transfer roller 35. In this way, an image is formed on the sheet 3.

The fixing device 40 is a device for thermally fixing a toner image transferred onto a sheet 3. The fixing device 40 is disposed in a position downstream relative to the process cartridge 30 on the sheet conveyance path. The fixing device 40 includes a heating roller 41, and a pressure roller 42 disposed opposite to the heating roller 41 and configured to be pressed against the heating roller 41.

A sheet 3 with a toner image thermally fixed thereon by the fixing device 40 is ejected out of the body casing 2, and placed on the sheet output tray 53, by an ejection roller 52 which is caused to rotate in a normal direction.

When images are formed on both sides of a sheet 3, the ejection roller 52 is so switched as to rotate in a reverse direction at a time before the sheet 3 is entirely ejected out onto the sheet output tray 53, and the sheet 3 is pulled back into the body casing 2. As a flapper 54 is actuated to shift its position, the sheet 3 pulled back into the body casing 2 passes along a rear side of the fixing device 40, and is forwarded into a duplex conveyance path unit 60.

The duplex conveyance path unit 60 is a return conveyance mechanism for duplex printing, and is disposed between the image forming unit 5 and the sheet feed tray 11. In this terminology, the "duplex conveyance" refers to a sheet conveyance scheme designed to return a reversed sheet 3 to a position upstream relative to the process cartridge 30 (i.e., on a guide plate 100 of FIG. 2, which will be described later in detail) so as to form an image on a back side of the sheet 3 of which a front side has an image formed thereon.

The duplex conveyance path unit 60 includes a guide member 61 and a plurality of pairs of return rollers 62. The guide member 61 is configured to receive a sheet 3 conveyed downward along the rear side of the fixing device 40, and to change a direction of conveyance of the sheet 3 from downward to frontward. The pairs of return rollers 62 are arranged in a frontward-and-rearward direction and configured to receive a sheet 3 guided (and turned frontward) by the guide member 61, and to return the sheet 3 toward a position upstream relative to the photoconductor drum 33. The sheet 3 output from the duplex conveyance path unit 60 is further guided by a guide 55 disposed in a position frontward relative to the duplex conveyance path unit 60, so that the reversed sheet 3 is forwarded toward the registration roller 17. Thus, the sheet 3 with its leading edge brought into proper alignment by the registration roller 17 is conveyed again to the photoconductor drum 33, and a toner image on the photoconductor drum 33 is transferred to the back side of the sheet 3.

Figure 2:
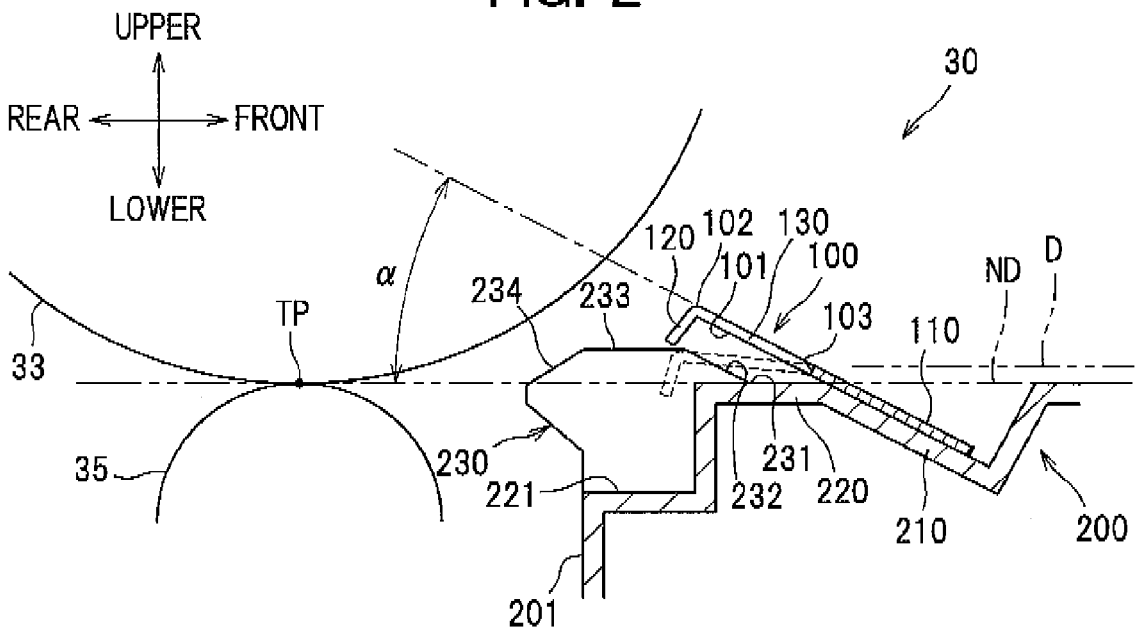
FIG. 2 is a schematic sectional view showing a structure and arrangement of and around a guide plate.
Figure 3:
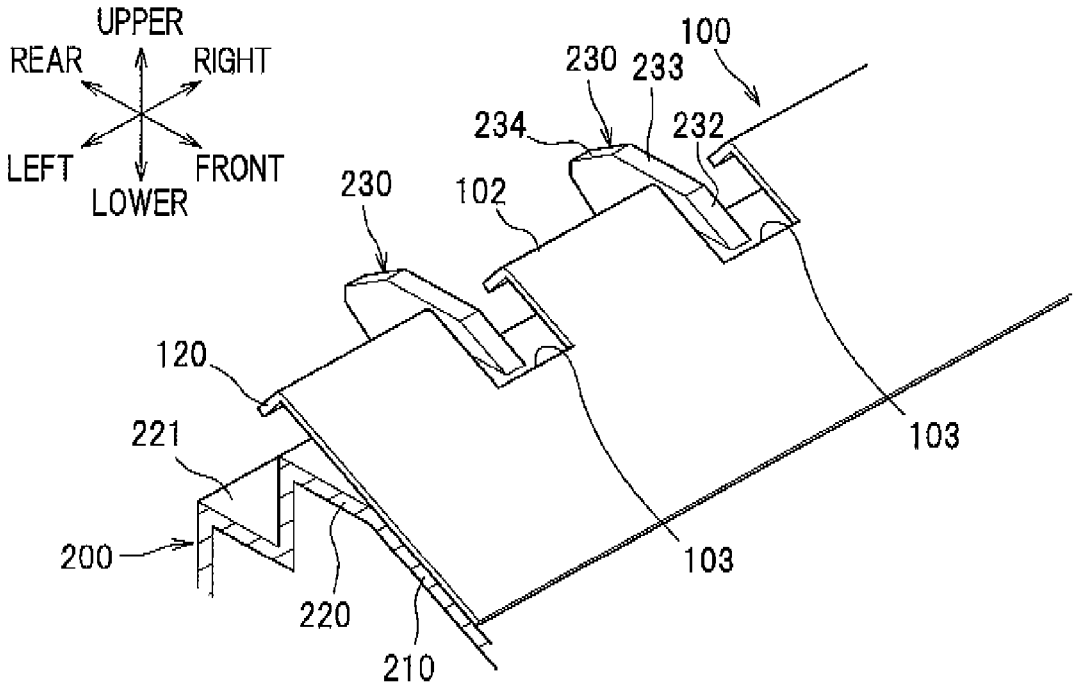
FIG. 3 is a schematic perspective view showing the structure and arrangement of and around the guide plate.

Next, referring to FIGS. 2 and 3, a detailed description will be given of a configuration of the process cartridge 30, particularly, of an arrangement around the photoconductor drum 33 and the transfer roller 35. It is to be understood that FIGS. 2 and 3 are illustrations simplified to facilitate understanding of the present invention. It is also to be understood that the specific configuration and arrangement shown in FIGS. 2 and 3 are omitted in illustration of FIG. 1 for clarity.

As shown in FIGS. 2 and 3, the photoconductor drum 33 and the transfer roller 35 are disposed opposite, facing downward and upward respectively, to each other, so that a nip contact (transfer position TP) is established between the photoconductor drum 33 and the transfer roller 35. In a position frontward of this transfer position TP (i.e., a position upstream relative to the transfer position TP along the sheet conveyance path), a guide plate 100 is provided which is a flexible plate configured and arranged to guide a sheet 3 toward the photoconductor drum 33. To be more specific, the guide plate 100 is in such an angled position that a leading edge of a sheet 3 guided by the guide plate 100 is brought into contact with the photoconductor drum 33 and then, while being kept in contact with the photoconductor drum 33, moved along the peripheral surface of the photoconductor drum 33 toward the transfer position TP. The guide plate 100 has an upper surface (shown without a reference numeral) as an example of a first side facing to the sheet 3 being conveyed along the sheet conveyance path, and an undersurface 101 reverse to the upper surface, as an example of a second side reverse to the first side.

The guide plate 100 is shaped like a plate and made of an elastically deformable and electrically insulating material, for example a resin such as polyethylene terephthalate. The material, shape and dimensions of the guide plate 100 are selected among various types of recording mediums considered to be usable in the laser printer 1 (e.g., a thin sheet of paper, a cardboard, a postcard, an OHP sheet, etc.), and the guide plate 100 to be selected may preferably be more rigid than the most flexible type and more flexible than the most rigid type. For example, in cases where polyethylene terephthalate is selected as a material of the guide plate 100, it is preferable that the thickness of the guide plate 100 be in a range of 80 μm to 200 μm. It is also considered to be preferable that the material and the shape be selected such that, for example, the product EI of the second moment of area I and the Young's modulus E be in a range of $3.49\times10^{-5}$ to $1.18\times10^{-3}$ ($N\cdot m^2$).

The guide plate 100 has a proximal end portion 110 (at an upstream end facing in a direction upstream of the sheet conveyance path) which is supported by a support frame 200, and a distal end portion 120 (at a downstream end facing in a direction downstream of the sheet conveyance path) which is free and thus allowed to rock; i.e., the guide plate 100 is configured as a cantilever. The guide plate 100 is bent, at a position (corner 102) near the downstream end of the guide plate 100, downward (toward an opposite portion 220 which will be described later) whereby the distal end portion 120 thereof is angled in a direction obliquely downward and downstream of the sheet conveyance direction.

With this configuration, after the trailing edge of a sheet 3 being conveyed along the sheet conveyance path passes the corner position (ridge line) 102 of the guide plate 100 at which the guide plate 100 is bent, the trailing edge of the sheet 3 continuously remains rested on the distal end portion 120 of the guide plate 120. Therefore, the "pre-transfer" which would result from increased separation of the sheet 3 from the photoconductor drum 33 can be prevented or reduced. Furthermore, the angled distal end portion 120 serves to smoothly guide the trailing edge of the sheet 3 to ribs 230 which will be described later, and thus noises which would be produced when the trailing edge of the sheet 3 comes in contact with the ribs 230 can be reduced.

The tilt angle α of the guide plate 100 may be set preferably in a range of $0°<\alpha\leq45°$, more preferably in a range of $10°<\alpha\leq35°$ where the tilt angle α is an angle which a middle portion 130 (i.e., a deflectable portion between the distal end portion 120 and the proximal end portion 110) of the guide plate 100 forms with a nip position medium conveyance direction ND. Herein, the "nip position medium conveyance direction ND" refers to a direction in which an image carrying member (photoconductor drum 33) and a transfer unit (transfer roller 35) convey a recording medium (sheet 3); in cases, as in the present embodiment, where the image carrying member and the transfer unit are both configured as rollers, the nip position medium conveyance direction ND is a direction of a common tangent of these members (33, 35) in side view.

The guide plate 100 protrudes rearward beyond a front edge 231 as an example of a first edge of each rib 230, which will be described later, and has a plurality of indentations 103 to allow the guide plate 100 to deflect without being blocked by a plurality of the ribs 230. To be more specific, the indentations 103 are formed in positions corresponding to those of the ribs 230, and configured to extend from the distal end of the guide plate 100 deep to appropriate positions (corresponding to the positions of the front edges 231 of the ribs 230) of the middle portion 130 of the guide plate 100.

With these indentations 103, the guide plate 100 can be deflected without being blocked by the ribs 230.

The corner (or bend) 102 of the guide plate 100 is shaped like a circular arc as viewed in cross section, for example, as a result of bending of the guide plate 100 made to form the distal end portion 120. When duplex printing is performed, a printed side of the sheet 3 (i.e., the surface provided with irregularities formed by selectively deposited toner) slides on the cross-sectionally arc-shaped corner 102 of the guide plate 100. Therefore, noises which would be produced particularly if the printed side of the sheet 3 slides for example on a sharply angular-shaped corner can be suppressed. The shape of the corner or bend 102 of the guide plate 100, i.e., the radius of curvature of the arc, may preferably be 0.1 mm or greater.

The support frame 200 includes a supporting portion 210 configured to support the guide plate 100, an opposite portion 220 configured to extend rearward from a rear end of the supporting portion 210, and a plurality of ribs 230 configured to protrude upward from the opposite portion 220. The supporting portion 210 provides a surface on which the guide plate 100 is to be supported and which forms the aforementioned tilt angle α with the nip position medium conveyance direction ND.

The opposite portion 220 extends rearward from the rear end of the supporting portion 210 in the nip position medium conveyance direction ND, and is thus disposed separate from and opposite to the underside 101 of the guide plate 100. On the rear side of the opposite portion 220, a stepped portion 221 as an example of a recess is formed to prevent the angled distal end portion 120 of the guide plate 100 from coming in contact with the opposite portion 220.

With this stepped portion 221, the guide plate 100 can be deflected without being blocked by the support frame 200 with which the angled distal end portion 120 of the guide plate 100 would otherwise be brought into contact. Moreover, provision of the stepped portion 221 makes it possible to provide an elongated distal end portion 120 (having a longer length in the direction of conveyance of the sheet 3), with the result that the trailing edge of the sheet 3 can be guided to a position closer to the ribs 230 by the distal end portion 120.

The ribs 230 are configured to protrude from the opposite portion 220 upward (toward the sheet conveyance path) and arranged in positions spaced out in the rightward-and-leftward direction (direction of a width of the sheet 3). Each rib 230 is dimensioned to have a width smaller than that of the guide plate 100 as measured in the rightward-and-leftward direction. Herein, the sheet conveyance path (medium conveyance path) refers to a path (space) through which a sheet 3 passes and which is defined by the guide plate 100, the ribs 230, the photoconductor drum 33, the transfer roller 35, and the like.

A front side of the rib 230 provides an inclined surface 232 extending from the front edge 231 in a direction obliquely rearward (downstream of the sheet conveyance path) toward the photoconductor drum 33. To be more specific, this front-side inclined surface 232 is inclined relative to a direction D in which a sheet 3 is conveyed by a mechanism (in this embodiment, the registration roller 17) for conveying a sheet 3 toward the guide plate 100.

With this front-side inclined surface 232, even if a sheet 3 conveyed to the guide plate 100 has such high stiffness that the distal end portion 120 of the guide plate 100 is caused to deflect downward beyond the rib 230, the inclined surface 232 serves to prevent the sheet 3 from being snagged on the ribs 230.

The ribs 230 are configured to protrude rearward (in the direction downstream of the sheet conveyance path) beyond a rear side 201 of the support frame 200 (the side which faces in the direction downstream of the sheet conveyance path). With this configuration, the sheet 3 can be guided to a position closer to the transfer position TP.

Each rib 230 is further configured to have, in addition to the front-side inclined surface 232, an upper surface 233 and a rear-side inclined surface 234. The upper surface 233 extends rearward from a rear end of the inclined surface 233 along the nip position medium conveyance direction ND. The rear-side inclined surface 232 extends from a rear end of the upper surface 233 in an obliquely rearward and downward direction. Provision of the rear-side inclined surface 234 makes it possible to support the trailing edge of a sheet 3 to a position so close to the nip contact as possible so that disturbance in transfer of toner can be prevented.

The present invention is not limited to the above-described specific embodiment, and it is to be understood that modifications and changes may be made to any part of the specific configuration, as will be described below, without departing from the scope of the present invention as claimed in the appended claims.

Although the stepped portion 221 is formed, in the above-described embodiment, as a structure for allowing the angled distal end portion 120 of the guide plate 100 to be moved without being blocked by the opposite portion 220 (i.e., preventing the distal end portion 120 from coming in contact with the opposite portion 220), but this specific configuration is exemplary only, and the present invention is not limited to this configuration. For example, instead of the stepped portion 221, a tubular recess with a bottom or a through hole may be provided for the same purposes.

In the above-described embodiments, the process cartridge 30 is illustrated by way of example, as a transfer device, but the present invention is not limited to this specific configuration. For example, in an alternative embodiment where a development cartridge by which a development roller is supported and a drum cartridge by which a photoconductor drum and a transfer roller are supported are two separate units to be assembled together, the drum cartridge may be considered to be a transfer device consistent with the present invention. Another alternative may be such that a transfer roller is provided in a main body of an image forming apparatus wherein the special technical feature of the present invention is embodied in the image forming apparatus which is thus can be considered to be a transfer device consistent with the present invention.

In the above-described embodiments, the photoconductor drum 33 is illustrated by way of example, as an image carrying member, but the present invention is not limited to this specific configuration. For example, a belt-type photoconductor may be used with a transfer device configured in accordance with the present invention.

In the above-described embodiment, the sheet 3 (e.g., of paper) such as a cardboard, a postcard, a thin sheet of paper, etc. is taken as an example of a recording medium, but the recording medium consistent with the present invention is not limited thereto, and an OHP sheet or the like may be adopted.

In the above-described embodiment, the transfer roller 35 is taken as an example of a transfer unit, but the transfer unit consistent with the present invention is not limited thereto. For example, a corotron-type or scorotron-type mechanism to which a transfer bias is applied may be adopted, instead. Alternatively, the transfer unit may be a conductive brush, a conductive leaf spring, or the like to which a transfer bias is applied.

What is claimed is:

1. A transfer device for transferring developer carried on a peripheral surface of an image carrying member onto a recording medium being conveyed along a medium conveyance path, comprising:

a transfer unit disposed opposite to the image carrying member and configured to transfer the developer from the peripheral surface of the image carrying member onto the recording medium;

a flexible guide plate having a first side and a second side reverse to the first side, the guide plate being disposed in a position along the medium conveyance path, upstream relative to a transfer position that is between the image carrying member and the transfer unit, such that the first side faces to the recording medium being conveyed along the medium conveyance path to guide the recording medium toward the image carrying member, the guide plate including an upstream end portion disposed at a side of the guide plate facing in a direction upstream of the medium conveyance path; and a support frame configured to support the upstream end portion of the guide plate, the support frame including an opposite portion and a rib, the opposite portion being disposed separate from and opposed to the second side of the guide plate, the rib being configured to protrude from the opposite portion toward the medium conveyance path and dimensioned to have a width smaller than that of the guide plate as measured in a direction of a width of the recording medium which is a direction perpendicular to a direction of conveyance of the recording medium, the rib having a first edge which is positioned at a side facing in the direction upstream of the medium conveyance path, and upstream of the rib, the guide plate protruding from the support frame in a direction downstream of the medium conveyance path, the rib having an inclined surface extending from the first edge in a direction obliquely downstream of the medium conveyance path toward the image carrying member, wherein the guide plate includes an indentation configured to accommodate the rib to allow the guide plate to be deflected toward the support frame without being blocked by the rib.

2. The transfer device according to claim 1, wherein the guide plate further includes a downstream end portion disposed at a side of the guide plate facing in the direction downstream of the medium conveyance path, the downstream end portion being an angled portion which is formed by bending the guide plate and extending in a direction obliquely downstream of the medium conveyance path toward the opposite portion.

3. The transfer device according to claim 2, wherein the opposite portion of the support frame has a recess or a hole formed to prevent the angled portion of the downstream end portion of the guide plate from coming in contact with the opposite portion.

4. The transfer device according to claim 1, wherein the rib is configured to protrude in the direction downstream of the medium conveyance path beyond a side of the support frame facing in the direction downstream of the medium conveyance path.

5. The transfer device according to claim 2, further comprising a return conveyance mechanism configured to reverse a recording medium with developer transferred thereon between the image carrying member and the transfer unit and to convey the reversed recording medium onto the guide plate, wherein a corner of the guide plate is shaped like a circular arc as viewed in cross section.

* * * * *